United States Patent [19]

Powell

[11] Patent Number: 4,860,435

[45] Date of Patent: Aug. 29, 1989

[54] CALIBRATION PROCESS FOR BIMETALLIC CIRCUIT BREAKERS

[75] Inventor: John R. Powell, Cumberland, Me.

[73] Assignee: GTE Products Corporation, Stamford, Conn.

[21] Appl. No.: 275,861

[22] Filed: Nov. 25, 1988

[51] Int. Cl.[4] ..... H01H 11/04

[52] U.S. Cl. ..... 29/622; 337/96; 337/360; 337/372

[58] Field of Search ..... 29/622; 337/368, 360, 337/371, 372, 347, 96

[56] References Cited

U.S. PATENT DOCUMENTS

| | | | |
|---|---|---|---|
| 3,223,808 | 12/1965 | Wehl | 337/360 |
| 3,430,177 | 2/1969 | Audette | 29/622 |
| 3,622,930 | 11/1971 | D'Entremont | 337/89 |
| 4,167,721 | 9/1979 | Senor et al. | 337/372 |
| 4,490,704 | 12/1984 | Snider et al. | 337/372 |
| 4,521,760 | 6/1985 | Carbone et al. | 337/368 |

*Primary Examiner*—P. W. Echols
*Assistant Examiner*—K. Jordan
*Attorney, Agent, or Firm*—James Theodosopoulos

[57] ABSTRACT

In the manufacture of a circuit breaker comprising a cover having a snap action blade attached thereto, with a movable contact mounted on the snap action blade, the optimum position of the movable contact with respect to a preselected locus is first determined and the movable contact is adjusted to the optimum position prior to closure of the circuit breaker. The optimum position prevents frying of the circuit breaker during operation.

5 Claims, 2 Drawing Sheets

CALIBRATION PROCESS FOR BIMETALLIC CIRCUIT BREAKERS

This invention is concerned with the method of calibration or adjustment of bimetal circuit breakers. Some such methods are shown in U.S. Pat. Nos. 3,587,022, 4,521,760, 4,636,766 and 4,663,606. This is particularly concerned with snap-action circuit breakers. Some such circuit breakers are disclosed in U.S. Pat. Nos. 3,555,478, 3,573,696, 3,573,697, 3,597,838, 3,619,534, 3,715,699, 3,753,191, 3,852,697, 3,933,022, 4,287,499 and 4,551,701.

In the prior art, calibration was performed by heating the circuit breaker (or passing electric current therethrough) to the temperature at which it was supposed to open. If it didn't open, pressure was applied to mechanically separate the contacts. Conversely, if the circuit breaker opened too soon, pressure was applied to keep the contacts together until the desired opening temperature was reached.

A problem with such methods of calibration is that a substantial number of the circuit breakers become "fryers", that is, arcing occurs between the contacts when the contacts open or when they close. If there is too little pressure between the contacts, the arcing occurs when he contacts open. If there is too much pressure between the contacts, the arcing occurs when the contacts close. It is a purpose of this invention to minimize or eliminate such an arcing problem.

In this invention, the optimum position of the movable contact with respect to a preselected locus during assembly is experimentally determined. Then, during assembly of the circuit breakers, the movable contacts are adjusted to locate them in said optimum position prior to closure of the circuit breaker case.

The drawing shows one example of a circuit breaker in accordance with this invention.

Figure 1:
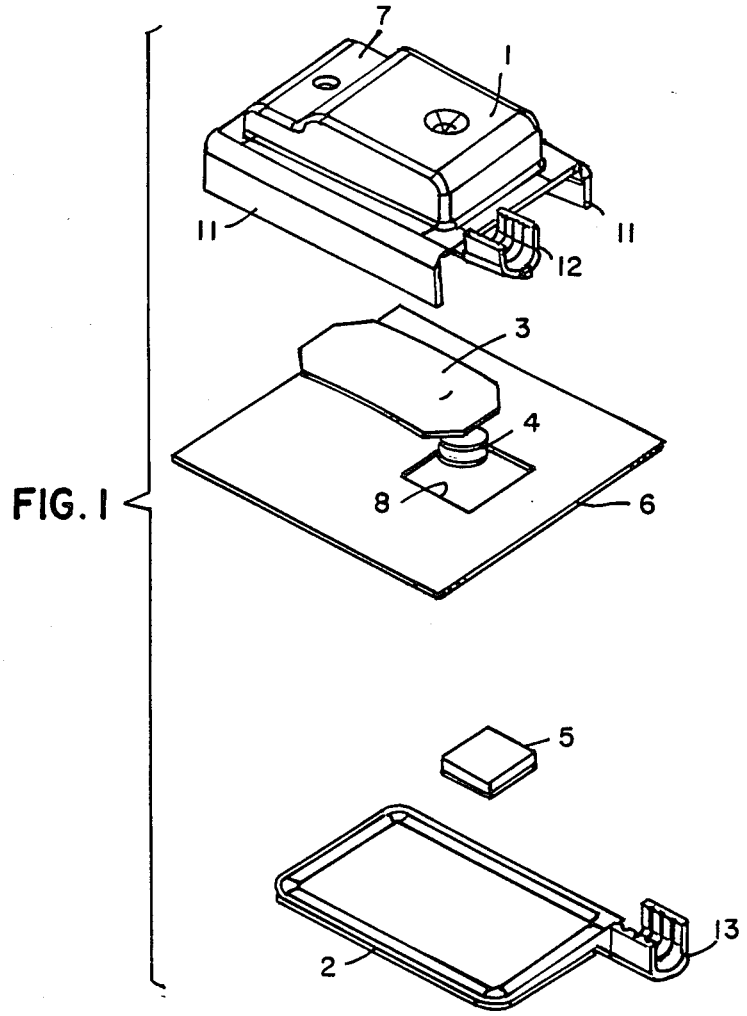
FIG. 1 shows the individual components.

The components of one example of a circuit breaker in accordance with this invention comprise a cover 1, a base 2, a snap action blade 3, a movable contact 4, a fixed contact 5 and an insulator 6.

One end of blade 3 is fastened, e.g. by welding or brazing, to a step 7 in cover 1. Movable contact 4 is similarly fastened to the other end of blade 3. Fixed contact 5 is similarly fastened to base 2. At assembly, insulator 6, e.g., an epoxy coated aramid paper, is disposed between cover 1 and base 2 to electrically insulate them from each other. There is an opening 8 in insulator 6 to permit physical contact between movable contact 4 and fixed contact 5.

In this example, the locus used to locate the position of movable contact 4 during assembly is bottom surface 9 of cover 1. Bottom surface 9 is a rim around the perimeter of cover 1 and is the surface against which the upper surface of insulator 6 bears after assembly. Bottom surface 9 defines a plane, plane A, which is the above mentioned locus.

Figure 2:
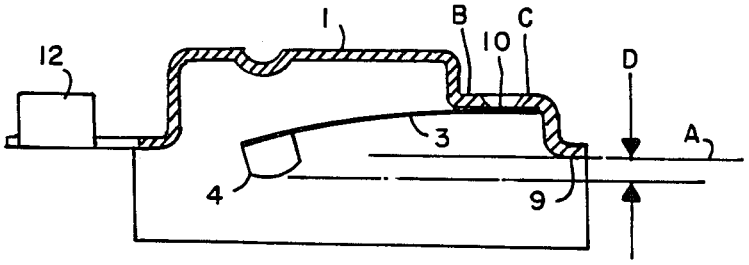
FIG. 2 is a sectional view of the cover with movable contact attached.
Figure 3:
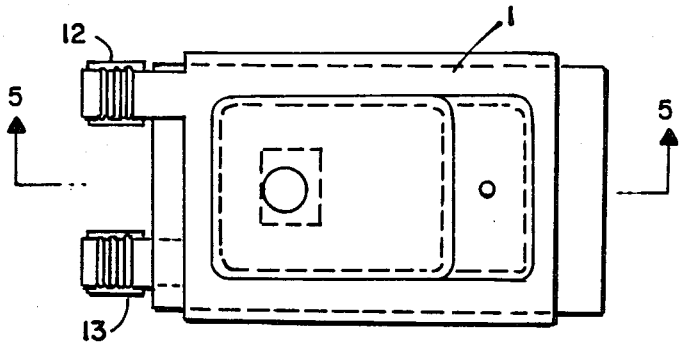
FIGS. 3, 4 and 5 are elevational, end and sectional views of a completed circuit breaker.
Figure 5:
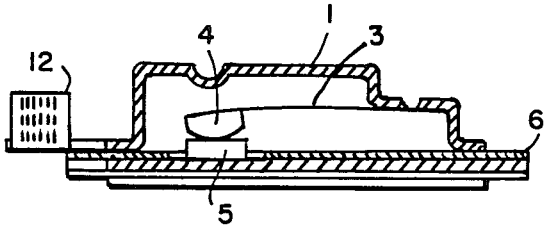

In this example, the optimum position for movable contact 4, prior to assembly of base 2 and insulator 6 to cover 1, is 10 mils, that is to say, the face of movable contact 4 should be 10 mils below plane A. This is distance D in FIG. 2. This distance was determined as follows. About 3 or 4 circuit breakers were made for each of D distances of 2, 4, 6, 8, 10, 12, 14 and 16 mils.

The circuit breakers were then tested by passing enough electrical current therethrough to cause them to open. The circuit breakers having a low D distance, say, 2 or 4 mils, would fry upon opening of the contacts. The circuit breakers having a high D distance, say, 14 or 16 mils, would fry upon closing of the contacts. The test was then repeated with larger numbers of circuit breakers for the range of D distances in the middle, say, 6, 8, 10 and 12 mils, in order to determine the D range in which no frying occurred. The exact center of this range is then selected as the optimum position for movable contact 4 prior to assembly.

The positioning of movable contact 4 at a D distance of 10 mils is done as follows. Cover 1 with blade 3 and movable contact 4 attached is placed in an apparatus having a micrometer-type adjustment to measure distance D. If D is greater than 10 mils, a short knife edge is slowly pressed against point C of step 7 to lift contact 4 until D equals 10 mils. If D is less than 10 mils, the knife edge is pressed against point B of step 7 to depress contact 4 until D equals 10 mils. There is a small depression 10 in step 7, between points B and C, which is the weld area of blade 3 to step 7.

Upon assembly of insulator 6 and base 2 to cover 1, movable contact 4 is moved upwards by an amount that equals D plus the thickness of fixed contact 5 minus the thickness of insulator 6. Thus, if contact 5 is 33 mils thick and insulator 6 is 9 mils thick, movable contact 4 is moved upwards about 34 mils. This displacement of 34 mils establishes the amount of contact pressure between contacts 4 and 5.

Figure 4:
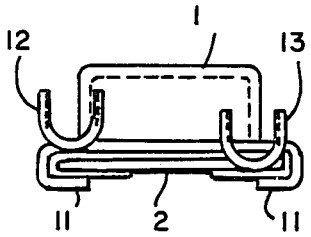

To assemble and close the circuit breaker, insultor 6 is placed between cover 1 and base 2, and then tabs 11 are bent down and around base 1, as shown in FIG. 4. Terminals 12 and 13 provide for connection to external electrical conductors.

I claim:

1. In the manufacture of a circuit breaker comprising a cover having a snap action blade attached thereto, with a movable contact mounted on the snap action blade, the steps comprising: determining, prior to final sealing of the circuit breaker, an optimum position of the movable contact with respect to a preselected locus to prevent frying of the circuit breaker during operation and adjusting the movable contact to said optimum position prior to said final sealing.

2. The steps of claim 1 wherein said preselected locus is a plane containing a surface of the cover.

3. The steps of claim 1 wherein the snap action blade is attached to a step in the cover and wherein adjusting of the movable contact to said optimum position is accomplished by pressing on said step.

4. The method of making a circuit breaker comprising a cover, a snap action blade having a movable contact thereon, an insulator and a base having a fixed contact thereon comprising the steps of: determining, prior to final sealing of the circuit breaker, an optimum position of the movable contact with respect to a preselected locus to prevent frying of the circuit breaker during operation and adjusting the movable contact to said optimum position prior to said final sealing; assembling the cover, insulator and base so that there is pressure contact between the movable contact and fixed contact and so that the insulator electrically insulates the cover from the base; and closing the cover around the base.

5. The method of claim 4 wherein said preselected locus is a surface of the cover against which the insulator bears.

* * * * *